US006978721B2

(12) United States Patent
Myers

(10) Patent No.: US 6,978,721 B2
(45) Date of Patent: Dec. 27, 2005

(54) FOLD-DOWN TABLE

(76) Inventor: Timothy J. Myers, 2762 Capri Road, Kelowna, British Columbia (CA) V1Z 3E6

( * ) Notice: Subject to any disclaimer, the term of this patent is extended or adjusted under 35 U.S.C. 154(b) by 166 days.

(21) Appl. No.: 10/697,985

(22) Filed: Oct. 31, 2003

(65) Prior Publication Data

US 2004/0089206 A1 May 13, 2004

Related U.S. Application Data

(60) Provisional application No. 60/422,895, filed on Nov. 1, 2002.

(51) Int. Cl.[7] ..... A47B 23/00
(52) U.S. Cl. ..... 108/48
(58) Field of Search ..... 108/42, 47, 48, 108/33, 34, 35, 36, 38, 41

(56) References Cited

U.S. PATENT DOCUMENTS

| | | | | |
|---|---|---|---|---|
| 279,290 | A * | 6/1883 | Von Der Wulbeke | 108/48 |
| 1,054,894 | A * | 3/1913 | Ball | 5/140 |
| 1,601,112 | A | 9/1926 | Cummings | |
| 1,688,533 | A | 10/1928 | Eger | |
| 1,796,635 | A | 3/1931 | Timmons | |
| 2,616,774 | A | 11/1952 | Prince | |
| 2,716,044 | A | 8/1955 | Overby | |
| 3,057,670 | A * | 10/1962 | Russo | 108/48 |
| 3,242,882 | A * | 3/1966 | Hoyt | 108/48 |
| 4,100,858 | A | 7/1978 | Bue et al. | |
| 4,136,622 | A | 1/1979 | Bue et al. | |
| 4,155,609 | A | 5/1979 | Skafte et al. | |
| 4,263,854 | A | 4/1981 | Moore et al. | |
| 4,382,641 | A | 5/1983 | Abel | |
| 4,779,539 | A | 10/1988 | Stiglich | |
| 5,513,574 | A | 5/1996 | Collins | |
| 5,669,314 | A * | 9/1997 | Grant | 108/48 |
| 5,819,670 | A * | 10/1998 | O'Connor et al. | 108/48 |
| 6,026,753 | A * | 2/2000 | Sharpe | 108/48 |
| 6,039,416 | A | 3/2000 | Lambert | |
| 6,161,486 | A * | 12/2000 | Boots | 108/48 |
| 6,405,392 | B2 * | 6/2002 | Schwalbe, Jr. | 5/136 |
| 6,786,162 | B1 * | 9/2004 | Volkmer et al. | 108/115 |

FOREIGN PATENT DOCUMENTS

| | | |
|---|---|---|
| WO | WO 94/13438 | 6/1994 |

* cited by examiner

*Primary Examiner*—Jose V. Chen
(74) *Attorney, Agent, or Firm*—Antony C. Edwards

(57) ABSTRACT

A fold-down work surface includes a planar top frame having first and second opposite ends and mounted thereto at least one parallelogram frame lying in a vertical plane orthogonal to a wall. The top frame is horizontal when deployed and vertical when raised into a storage position adjacent the wall. Each parallelogram frame is mounted to a corresponding slide. The top frame, a lower longitudinal element, the slide, and a vertical leg for each parallelogram frame form a frame pivotable in the corresponding vertical plane. Each slide is slidably mounted in a vertical track which is mountable to the wall. The top frame is constrained to rotate about the upper end of a primary brace member. The lower end of the primary brace member is pivotally mounted to the wall.

16 Claims, 8 Drawing Sheets

20
8
44a
24
90d
A
44b
90c
90
52
90d
90a
52
90b
B
80
58a

FOLD-DOWN TABLE

CROSS REFERENCE TO RELATED APPLICATION

This application claims priority from U.S. Provisional Patent Application No. 60/422,895 filed Nov. 1, 2002 entitled Fold-Down Table.

FIELD OF THE INVENTION

This invention relates to the field of folding planar work surfaces generally and in particular to a table which folds up flush against a wall so as to substantially occupy the full wall height.

BACKGROUND OF THE INVENTION

Space in workshops or in homes is always at a premium. Consequently, it is well known in the prior art that solid surfaces such as tables or other work surfaces including beds, boards or other planar supports which fold down from a wall may be employed for a variety of purposes including everything from woodworking, to sewing, to crafts, to medical applications, etc. What is to the best of applicant's knowledge missing in the prior art and which is an object of the present invention to provide, is an improved folding work surface which folds neatly up against a wall and which deploys from the wall to provide a work surface having a length for example substantially equivalent to the full height of the wall between the floor and ceiling of the room, or otherwise generally equal to the height of the surface it is connected to. For example the work surface could be mounted within a box or cabinet, as in a fold-down first aid station, in which case it may be a bed and not a table. A horizontal surface extension is also provided which does not fold upwardly but, rather, remains operatively horizontal as the work surface is retracted and deployed that is, folded up and down, where, in the retracted position, the horizontal extension is tucked up out of the way adjacent the ceiling.

In the prior art of which applicant is aware, the following patents for folding tables mounted to walls, either taken individually or collectively, neither teach nor suggest the improvements according to the present invention: U.S. Pat. No. 1,601,112 which issued Sep. 28, 1926 to Cummings for a Wall Fixture; U.S. Pat. No. 1,688,533 which issued Oct. 23, 1928 to Eger for a Combination Work Bench and Tool Holder; U.S. Pat. No. 1,796,635 which issued Mar. 17, 1931 to Timmons for a Folding Wall Table; U.S. Pat. No. 2,616,774 which issued Nov. 4, 1952 to Prince for a Slide Away Table and Holding Frame Therefor; U.S. Pat. No. 2,716,044 which issued Aug. 23, 1955 to Overby for a Folding Wall Table; U.S. Pat. No. 4,100,858 which issued Jul. 18, 1978 to Bue et al. for a Folding Wall Table; U.S. Pat. No. 4,136,622 which issued Jan. 30, 1979 to Bue et al. for a Folding Wall Table; U.S. Pat. No. 4,155,609 which issued May 22, 1979 to Skafte et al. for a Wall-Hung Cabinet Arrangement; U.S. Pat. No. 4,263,854 which issued Apr. 28, 1981 to Moore et al. for a Cutting Table Storage Mechanism; U.S. Pat. No. 4,382,641 which issued May 10, 1983 to Abel for a Sewing Machine Storage Cabinet; U.S. Pat. No. 4,779,539 which issued Oct. 25, 1988 to Stiglich for a Wall-Mountable Folding Table; U.S. Pat. No. 5,513,574 which issued May 7, 1996 to Collins for a Wall Mounted Table Apparatus; U.S. Pat. No. 6,039,416 which issued Mar. 21, 2000 to Lambert for a Wall Mounted Pivoting Work Bench; International Application No. PCT/GB93/01340 filed Jun. 25, 1993 and published under Publication No. WO 94/13438 on Jun. 23, 1994 to Mallows for a Folding Workbench.

SUMMARY OF THE INVENTION

The fold-down work surface of the present invention is intended to include all manner of planar rigid horizontal supports including tables, beds, boards, etc.

In summary, the fold-down work surface according to the present invention includes a planar top tame having first and second opposite ends and mounted thereto at least one parallelogram frame. Each parallelogram frame is mounted to corresponding slides, the top frame forming an upper longitudinal element in each parallelogram frame. A rigid table top may be mounted onto the top frame. Each parallelogram frame lies in a corresponding vertical plane, and includes a lower longitudinal element, parallel to the frame, extending between the corresponding slide at a first end of the lower longitudinal element and at least one leg at an opposite second end of the lower longitudinal element. Each corresponding slide and each leg, at the corresponding second end of the lower longitudinal element, is pivotally mounted to or adjacent the first and second ends of the top frame and to the opposite first and second ends of the lower longitudinal element so that the top frame, the lower longitudinal element, the slide, and the leg for each parallelogram frame form a frame pivotable in the corresponding vertical plane. Each slide is slidably mounted in a vertical track which is mountable to a vertical rigid supporting surface, such as a wall, having a constraining upper edge, such as the upper edge of the wall where the wall adjoins the ceiling.

At least one primary brace member is pivotally mountable, by mounting means at a lower end thereof, to the supporting surface. An opposite upper end of each primary brace member is pivotally mounted to the top frame adjacent the first end of the top frame so that the upper end of the each primary brace member is pivotally mounted to, so as to be disposed between, the top frame and the mounting means when mounted adjacent the vertical track on the supporting surface.

As the top frame is raised or lowered relative to the supporting surface, when the vertical track and primary brace member are mounted to the supporting surface, translation of the first end of the top frame is constrained by rotation of the top frame about the upper end of each primary brace member and by vertical sliding translation of each slide in its corresponding vertical track. Thus, as the second end of the top frame is raised in an arc so that the second end is brought into adjacency with the constraining upper edge of the supporting surface, as the top frame is brought flush with the supporting surface the first end of the top frame is lowered into adjacency with the bottom of the supporting surface.

The primary brace member may include a pair of rigid linear braces, each associated with a corresponding slide in a corresponding track mountable to the support surface. The pair of braces may be spaced apart and parallel and the corresponding tracks may also be correspondingly spaced apart and parallel.

Advantageously, when the top frame is in a fully deployed position, the top frame is horizontal, for example perpendicular from the supporting surface, the leg is vertical, and a lower end of each leg is in contact with the floor surface. The legs may be a spaced apart pair of parallel generally linear legs mounted at and to the second end of the support frame. As the top frame is rotated so as to raise or lower the second end of the top frame, each leg remains vertical, parallel to the slide.

In one embodiment a container or work surface extension or leaf may be mounted to the legs so as to remain in a constant horizontal orientation relative to the supporting surface as the top frame is rotated to raise or lower the second end of the top frame. The work surface extension may be mounted to each leg so as to protrude outwardly of the top frame. It may be generally co-planar therewith when the top frame is in its deployed position. It remains level as the top frame is rotated to raise or lower the second end of the top frame, whereby, once raised, the extension is stored out of the way adjacent the top edge of the supporting surface. The extension may be braced by secondary brace members mounted between the extension and each leg. A rigid table top extension may be mounted onto the work surface extension. A tool support frame may also be mounted in the top frame for mounting of a tool such as for example a power saw, into the top frame.

In a further embodiment a housing, such as a cabinet, is provided mountable to the supporting surface and around the top frame when the top frame is raised flush against the supporting surface in a stored position. The housing encloses the top frame, each parallelogram frame, the lower longitudinal element, the primary brace members, the slides and the tracks within the housing. Thus, only the housing is visible to an observer when the top frame is in the stored position and doors on the housing are closed.

Latch means may be provided for releasably latching the top frame flush against the supporting surface when the top frame is raised flush against the supporting surface in its stored position.

A resilient means, such as a helical spring, may be mounted for example in cooperation between the slide and the track so as to resiliently resist rotation of the top frame from its stored position raised flush against the supporting surface to its deployed lowered position. The resilient means resiliently urges the top frame from the deployed position into the stored position, sufficiently so that merely a reasonable manual force exerted upwardly on the second end of the top frame is sufficient to raise and smoothly lower the top frame.

DETAILED DESCRIPTION OF EMBODIMENTS OF THE INVENTION

The fold-down work surface according to the present invention and as defined above, one example of which is the illustrated embodiment, is meant to provide a work surface such as a table having a working surface thereon which folds up against a wall or other vertical rigid supporting surface, where the length of the working surface may be substantially equivalent to the height of the supporting surface, such as a wall it is mounted to, plus the length of a fold-out leaf or extension. In the embodiment illustrated, the solid top of the fold-out work surface is cut away for sake of clarity of the drawings, it being understood that in use, a rigid top surface would be inset within or otherwise mounted onto the top frame 8 so as to provide a rigid working surface thereon.

Figure 1:
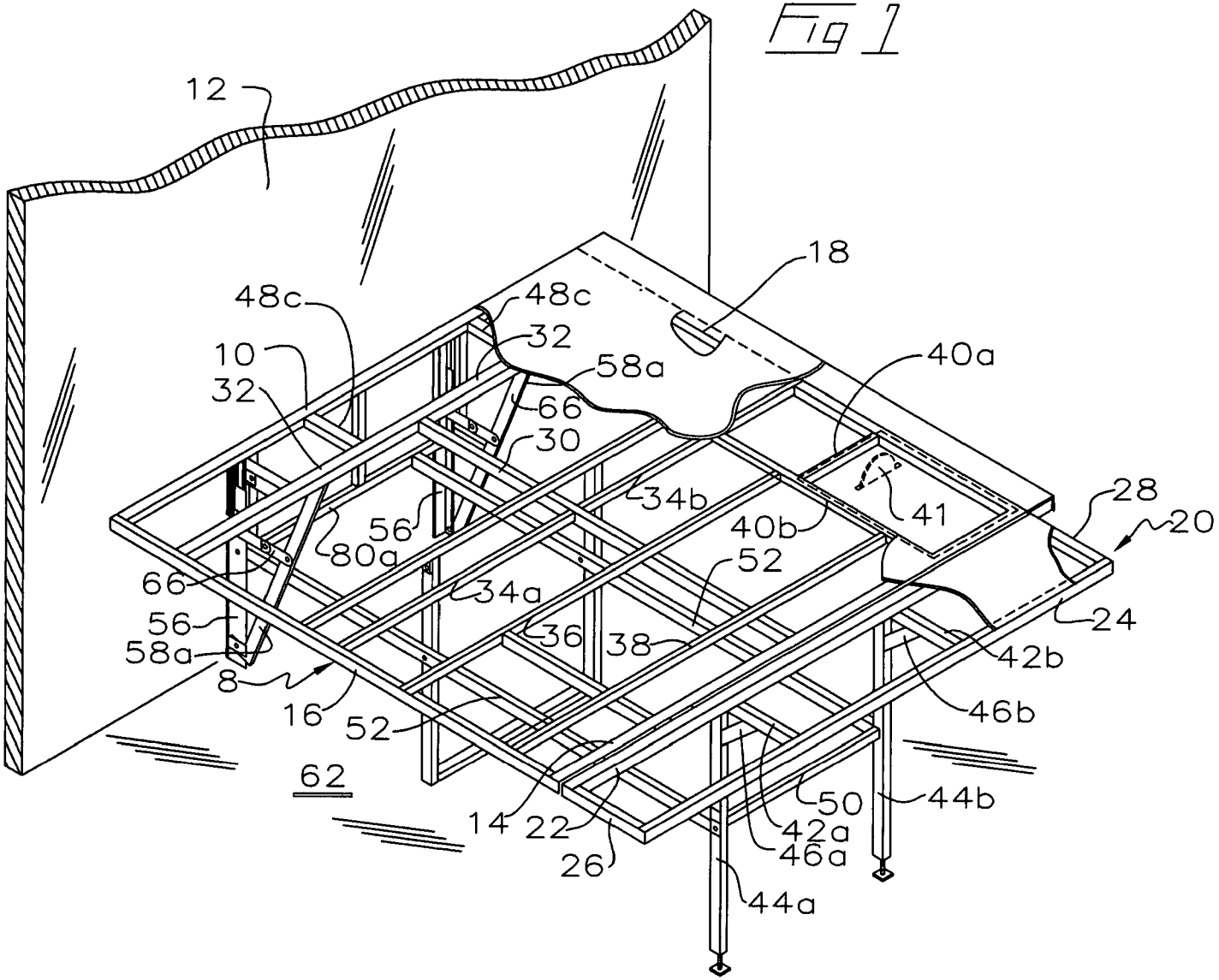
FIG. 1 is, in perspective view, the folding work surface according to the present invention in its fully deployed position with the upper surface partially cut away.
Figure 2:
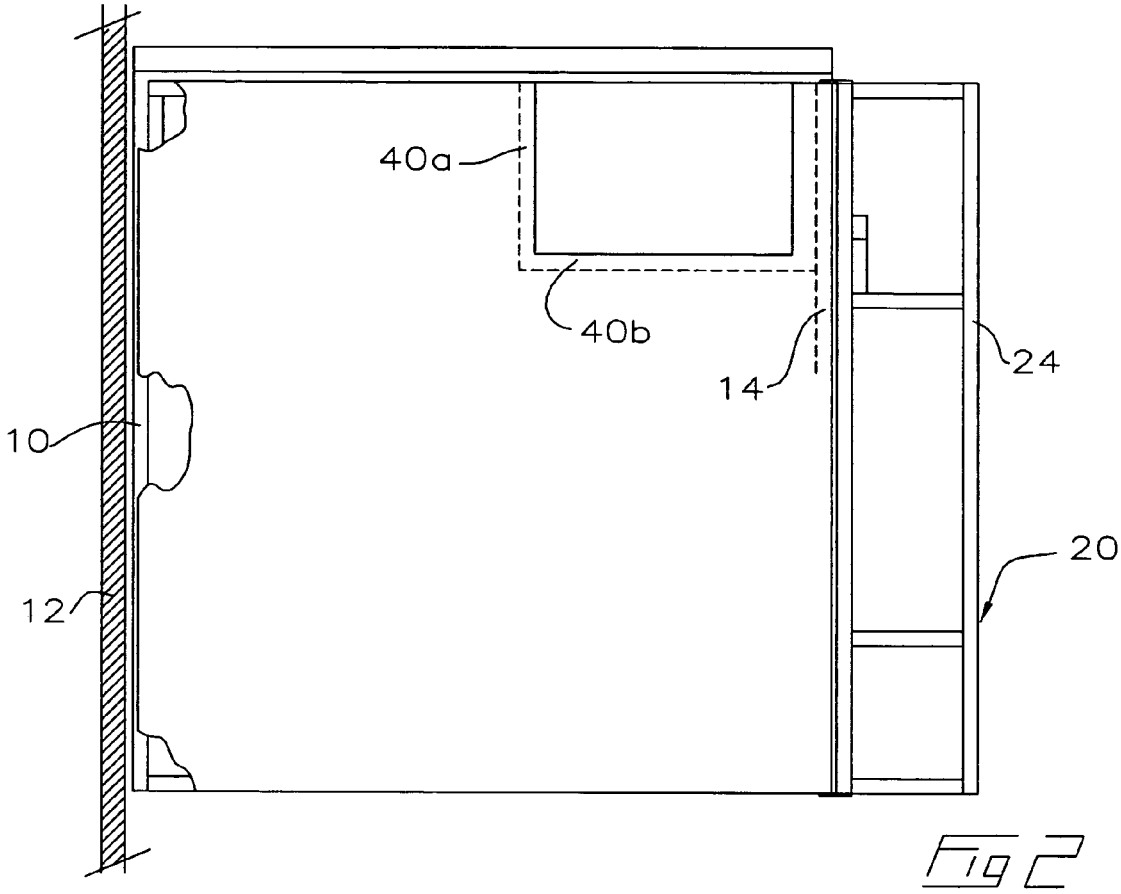
FIG. 2 is a plan view of the table of folding work surface of FIG. 1.
Figure 3:
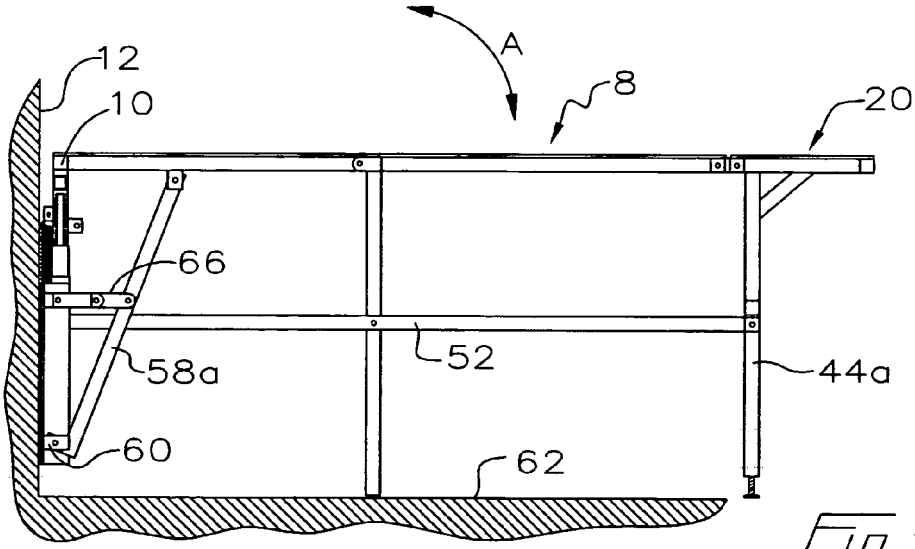
FIG. 3 is, in side elevation, the folding work surface of FIG. 2.
Figure 4:
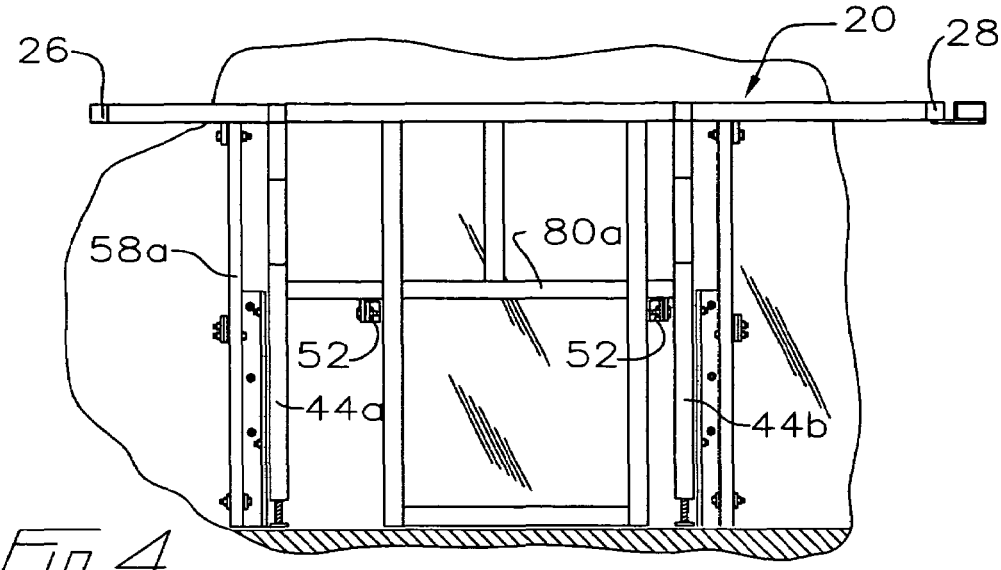
FIG. 4 is, in front-elevation, the folding work surface of FIG. 2.

Thus, in the figures wherein similar characters of reference denote corresponding parts in each view, and as seen starting in FIG. 1, the folding frame, with the rigid top cut away, includes an outer frame having abase element 10 which extends flush along a vertical rigid supporting surface such as wall 12 parallel to, and oppositely disposed to, end element 14. Elements 10 and 14 extend laterally across the width of the work surface. A pair of length-wise or longitudinally extending side members 16 and 18 are rigidly mounted to the ends of elements 10 and 14 to form a rectilinear frame, for example, the rectangular frame illustrated. The top frame so formed is planar, and in the fully deployed position of FIGS. 1 and 3, is coplanar with a rigid top leaf or extension 20.

Extension 20 has itself a base element 22 adjacent and parallel to end element 14, and an end element 24 spaced apart from and parallel to base element 22. Extension 20 may also be rectangular although this is not intended to be limiting, the ends of base element 22 and end element 24 being rigidly connected by side members 26 and 28. Extension 20 may further include bracing members 42*a* and 42*b* extending in spaced parallel array between base element 22 and end element 24.

Top frame 8 may also include a center-line, longitudinally extending support member 30 which extends parallel to, and equi-distant between, side members 16 and 18. It is rigidly connected at its ends to base element 10 and to cross member 32. Member 32 is parallel to end element 10, and is rigidly mounted between side members 16 and 18 and. Top frame 8 may also further include laterally extending cross-members such as cross members 34*a* and 34*b* and cross members 36, 38 and 40*a*. Cross member 40*a* may in conjunction with longitudinally extending stringer 40*b* form a tool supporting frame which, in the example illustrated, is a table saw 41. It is understood however that the various arrangement of cross bracing members and longitudinally extending stringers may be arranged to accommodate a variety of built-in tools or other utilitarian items such as sewing machines, or merely other horizontal work surfaces which may be advantageously flush-mounted into top frame 8.

Top frame 8 and extension 20 are, when the work surface is in its fully deployed position, supported at the distal end of top frame 8 by a pair of vertically extending legs 44*a* and 44*b* rigidly mounted at their upper ends to base element 22 so as to extend downwardly perpendicularly therefrom. Rigid braces or struts, for example, struts 46*a*, and 46*b* are rigidly mounted between end element 24 and legs 44*a* and 44*b*. A horizontal cross member 50 is rigidly mounted between legs 44*a* and 44*b*.

Figure 6:
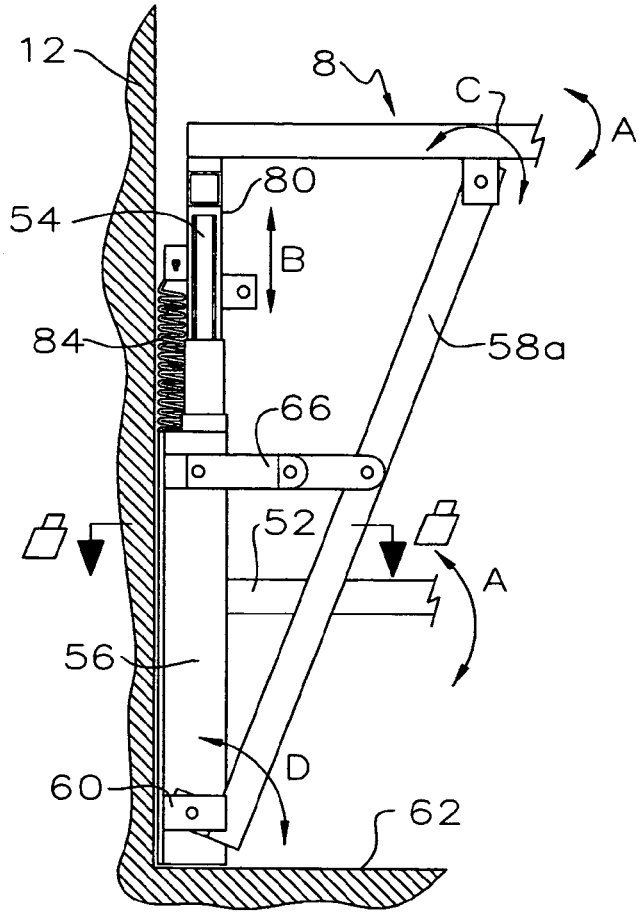
FIG. 6 is a partially cut away enlarged portion of FIG. 3.
Figure 7:
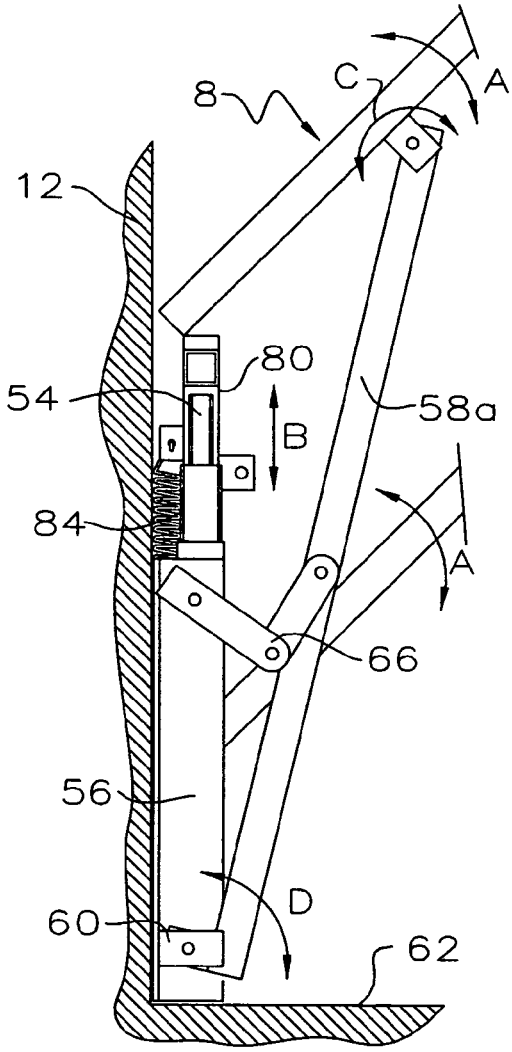
FIG. 7 is the view of FIG. 6 with the fold-down work surface partially retracted.
Figure 8:
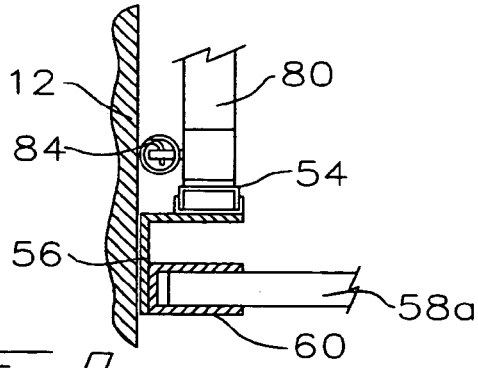
FIG. 8 is, a sectional view taken on line 8—8 in FIG. 6.
Figure 9:
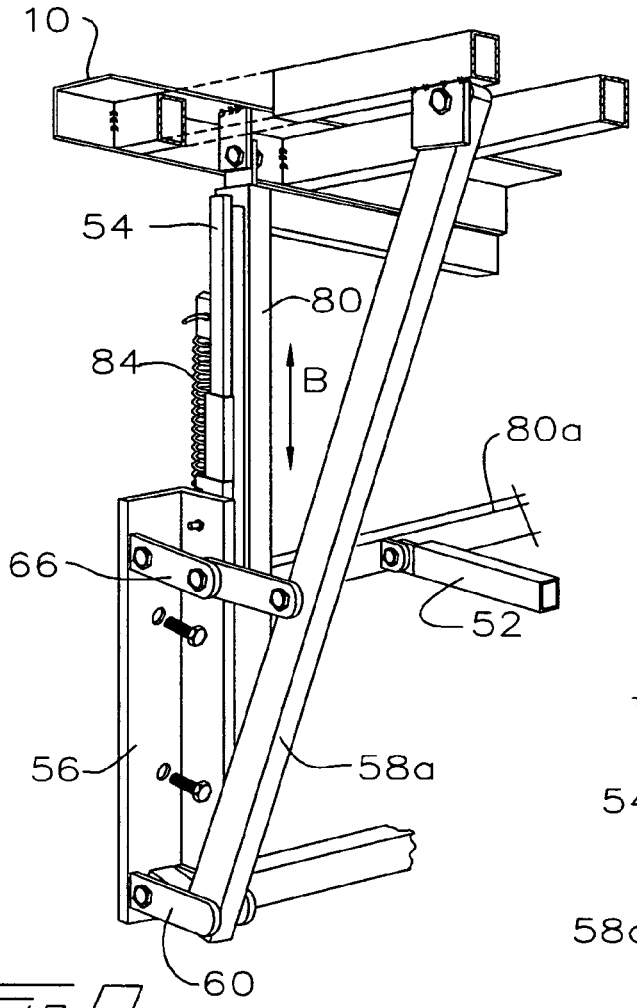
FIG. 9 is, in partially cut away perspective view, the view of FIG. 6.
Figure 10:
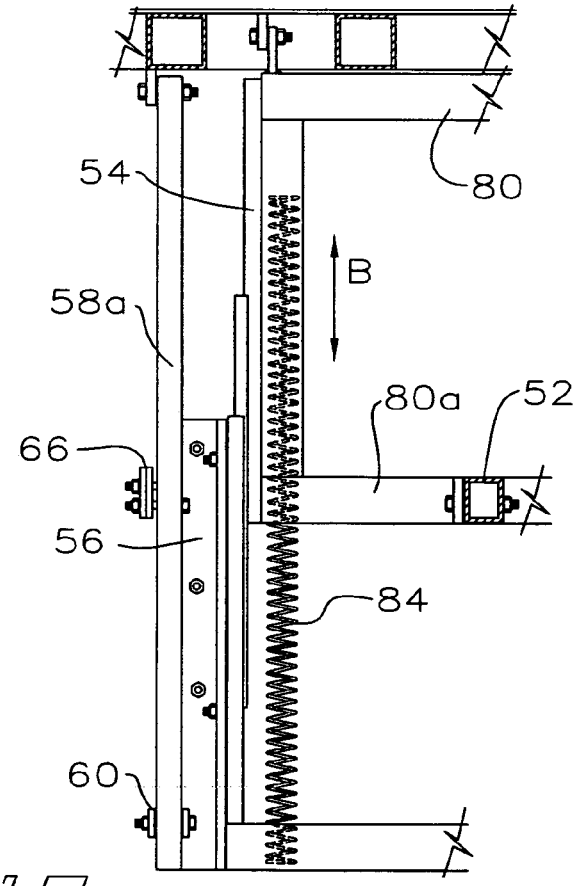
FIG. 10 is, in partially cut away front elevation view, the view of FIG. 4.

Legs 44*a* and 44*b* are pivotally mounted to a longitudinally extending pair of rigid parallelogram members 52. The opposite end of parallelogram members 52 are pivotally mounted to the lower cross member 80*a* of a rigid frame 80. Vertical side members 80*b* of frame 80 are mounted to vertically extended rigid slide posts 54 better seen in FIGS. 6 through 8. Posts 54 are slidably mounted on slides 82 for vertical sliding movement on wall mounting members 56 which are bolted or otherwise fixed to wall 12. Posts 54 along with frame 80 are resiliently urged in a downward direction toward floor 62 by springs 84. The upper edge of frame 80 is pivotally mounted to base element 10. Thus, a parallelogram structure lying in a vertical plane when viewed in side elevation is formed by frame 80 being pivotally mounted to parallelogram members 52, and the pivotal mounting of frame 80 and parallelogram member 52 at their opposite ends to, respectively, the wall end of top frame 8 and to the vertical supports, legs 44*a* and 44*b* for example, beneath the opposite distal end of top frame 8.

Figure 5:
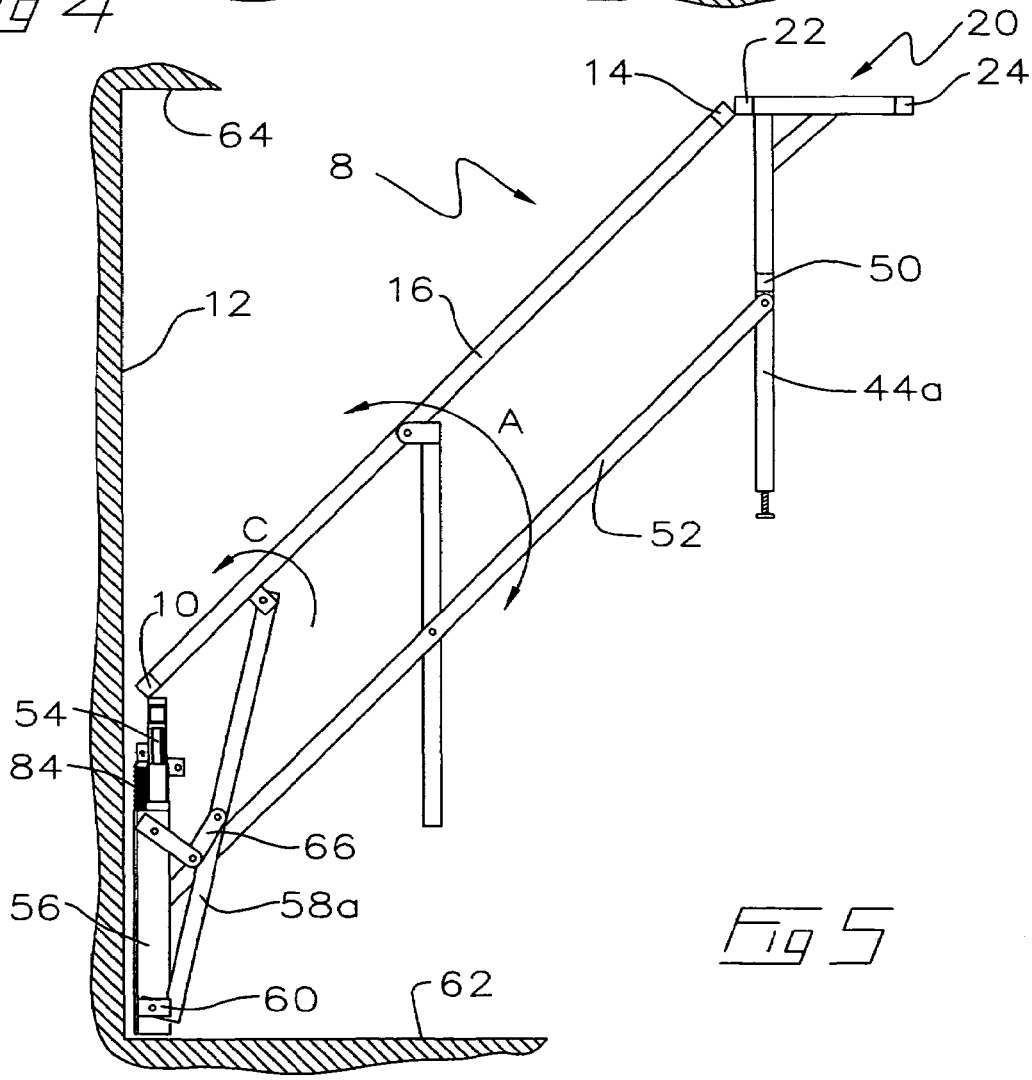
FIG. 5 is, in side elevation the folding work surface of FIG. 1 in an intermediate position between a fully retracted and fully deployed position.
Figure 5D:
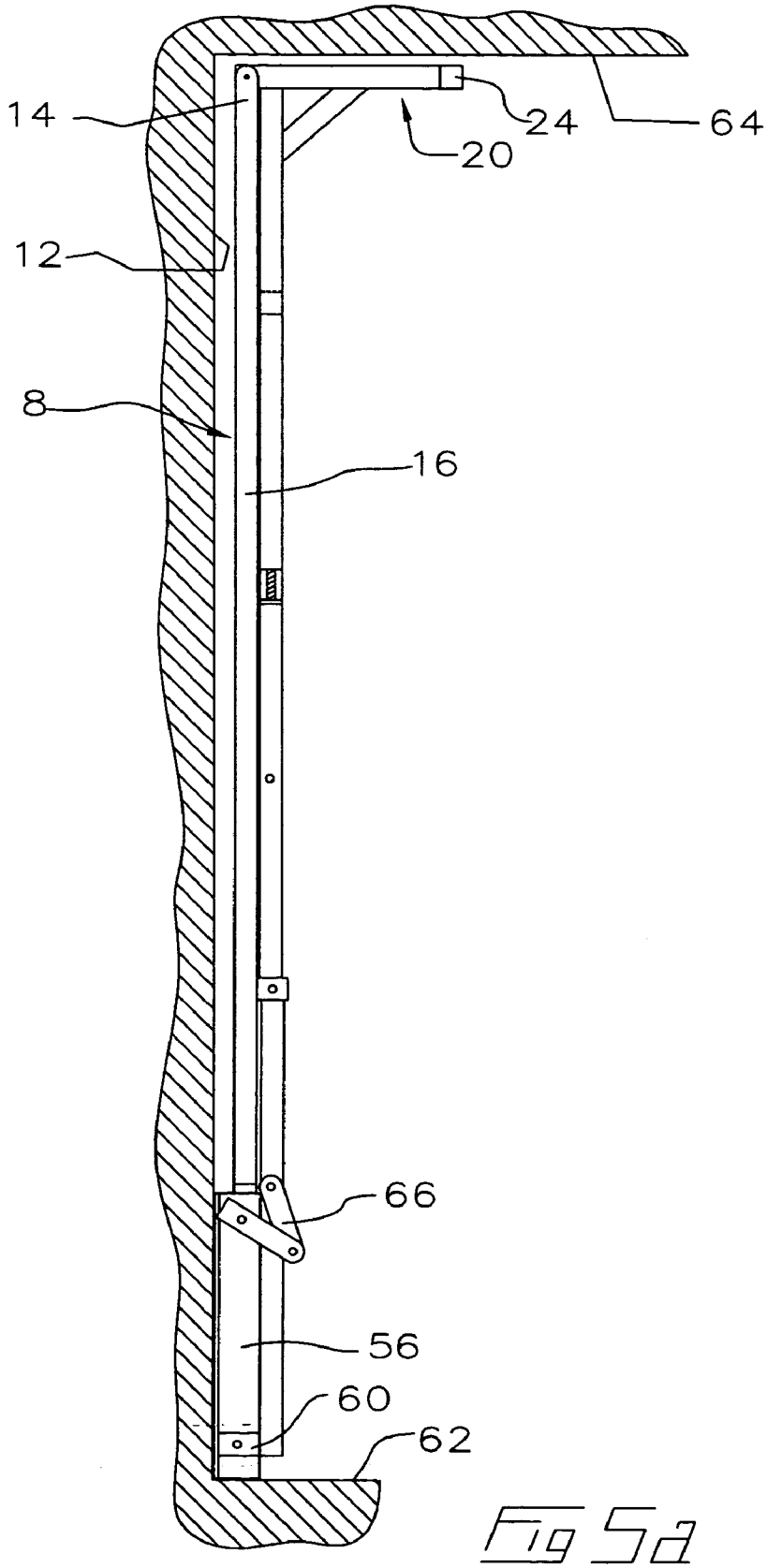
FIG. 5*a* is, in side elevation the folding work surface of FIG. 1 in a fully retracted position.
Figure 11:
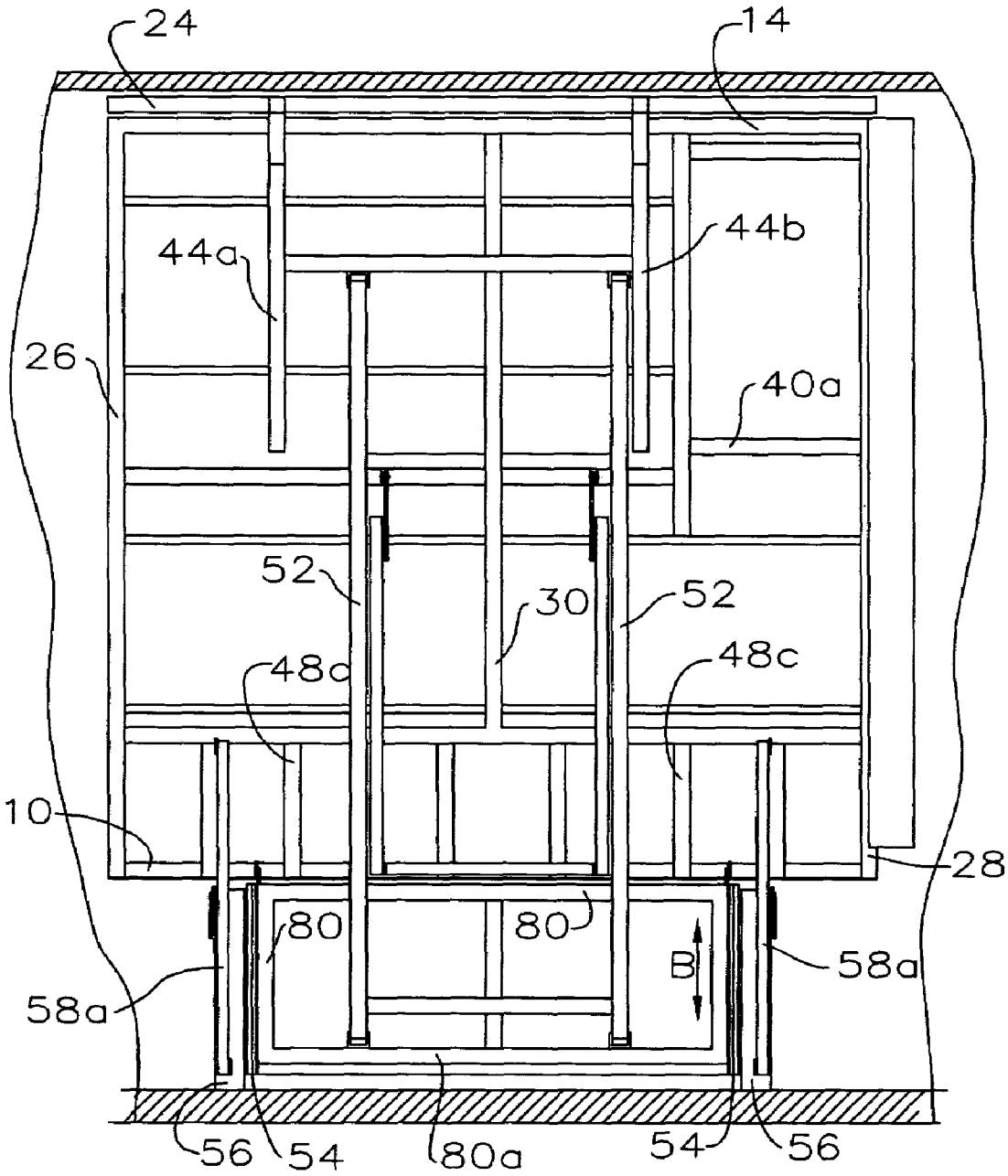
FIG. 11 is, in front elevation view, the folding work surface of the present invention in its fully retracted position folded up against a wall.

Frame 80 and posts 54 slide vertically in direction B as top frame 8 is rotated in direction A between its deployed and retracted positions. This is accompanied by pivoting in direction C of top frame 8 about the upper ends of bracing members 58*a* and simultaneous rotation of bracing members 58*a* in direction D relative to wall mounting members 56. As the top frame is deployed or retracted between the fully deployed position of FIGS. 1–4 and the fully retracted position of FIGS. 5*a*, 11 and 12 by rotation of top frame 8 in direction A, frame 80 remains vertical and legs 44*a* and 44*b* also remain vertical. Consequently, as top frame 8 is rotated in direction A, extension 20 remains horizontal not only at the fully deployed and fully retracted positions but also during intermediary positions such as seen in FIG. 5 as top frame 8 is raised or lowered. Folding latch arm 66 prevents over-rotation of bracing members 58*a* in direction D as top frame 8 is brought down in direction A to the horizontal.

The upper ends of bracing members 58*a* are pivotally mounted to cross member 32. The lower ends of bracing members 58 are pivotally mounted to brackets 60 on wall mounting members 56 rigidly mounted to wall 12. Thus, as top frame 8 is raised so as to rotate towards its retracted position flush up against wall 12, the end of top frame 8 adjacent the wall, that is, base element 10, slides downwardly in direction B along the wall. As frame 80 slides downwardly along wall mounting members 56, top frame 8 is constrained to rotate about the upper end of bracing members 58*a*. In this fashion, and so long as the longitudinal length of top frame 8 does not exceed the height of wall 12 between the top of frame 80 and ceiling 64, as base element 10 is lowered so as to bring frame 80 into adjacency with floor 62, end element 14 and horizontal extension 20 are raised into flush adjacency with the upper edge of wall 12 and the intersection of wall 12 with ceiling 64.

Figure 12:
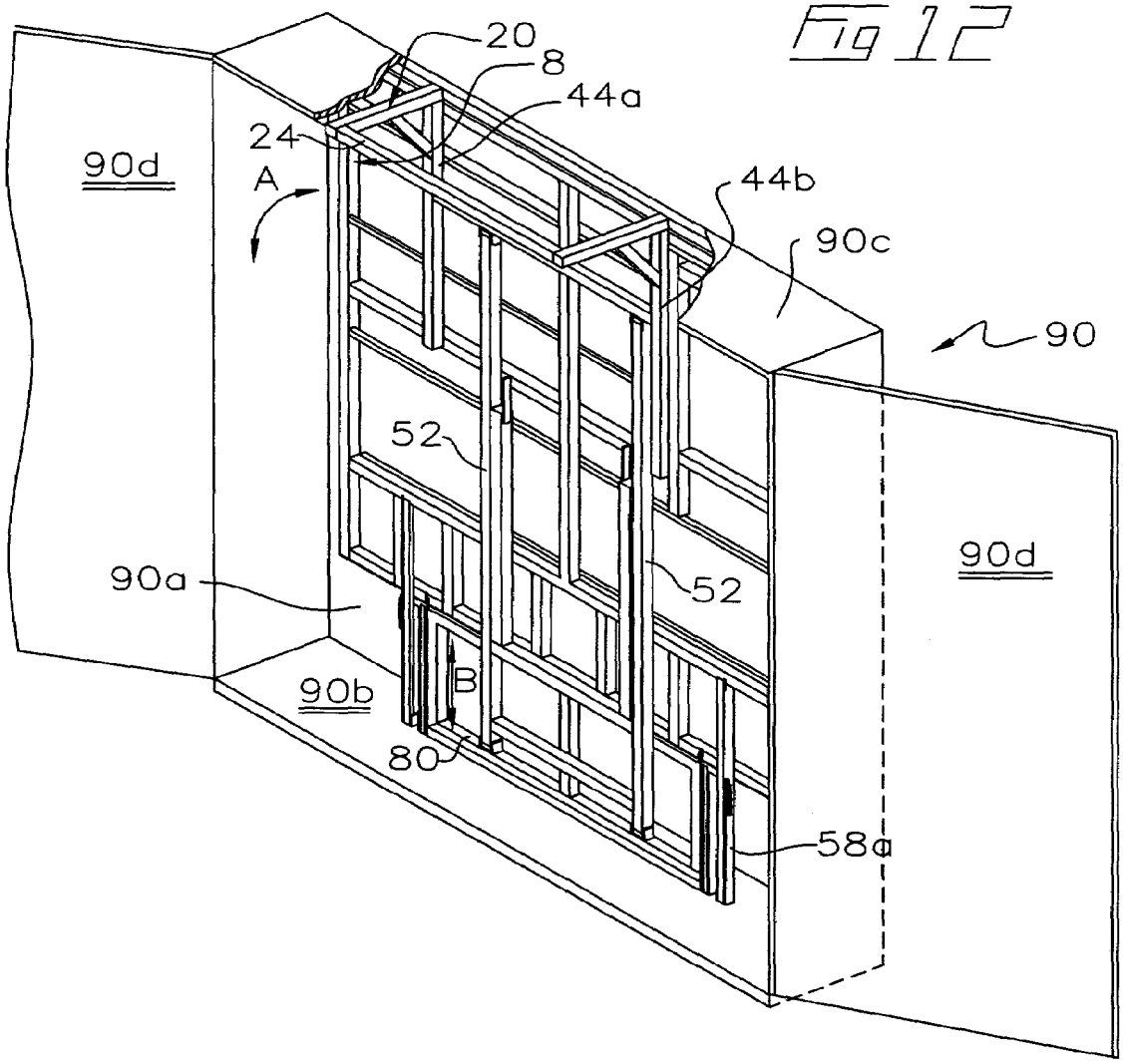
FIG. 12 is, in perspective view, the folding work surface according to the present invention in its retracted position housed within a cabinet.

Alternatively, top frame 8 may be sized so as to retract into a cabinet 90 or other housing or wall-mounted container as seen in FIG. 12. Instead of folding up adjacent wall 12, ceiling 64 and floor 62, top face 8 folds up adjacent the back. 90*a* of the cabinet with base element 10 and frame 80 adjacent the floor 90*b* of the cabinet, and extension 20 adjacent the ceiling 90*c* of the cabinet. The entire fold-up work surface may then be enclosed out-of-sight within cabinet 90 by closing doors 90*d*.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A fold-down work surface comprising:

a planar top frame having first and second opposite ends and mounted thereto at least one parallelogram frame, said at least one parallelogram frame mounted to corresponding slides, said top frame forming an upper longitudinal element in said at least one parallelogram frame, each parallelogram frame of said at least one parallelogram frame lying in a corresponding vertical plane, and including a lower longitudinal element, parallel to the said frame, extending between said corresponding slides at a first end of said lower longitudinal element and at least one leg at an opposite second end of said lower longitudinal element, each said corresponding slide and each leg of said at least one leg, at the corresponding said second end of said lower longitudinal element, pivotally mounted to said first and second ends of said top frame and to the opposite first and second ends of said lower longitudinal element so that said top frame, said lower longitudinal element, said slide, and said leg for each parallelogram frame form a frame pivotable in said corresponding vertical plane, wherein each said slide is slidably mounted in a vertical track which is mountable to a vertical rigid supporting surface having a constraining upper edge, wherein at least one primary brace member is pivotally mountable, by mounting means, at a lower end thereof to the supporting surface, and an opposite upper end of each primary brace member of said at least one primary brace member is pivotally mounted to said top frame adjacent said first end of said top frame so that said upper end of said each primary brace member is pivotally mounted to, so as to be disposed between, said top frame and said mounting means when mounted adjacent said vertical track on said supporting surface, wherein, as said top frame is raised or lowered relative to the supporting surface, when said vertical track and primary brace member are mounted to the supporting surface, translation of said first end of said top frame is constrained by rotation of said top frame about said upper end of said each primary brace member and by vertical sliding translation of said each slide in its corresponding said vertical track so that, as said second end of said top frame is raised in an arc so that the second end is brought into adjacency with the constraining upper edge of the supporting surface as said top frame is brought flush with the supporting surface, said first end of said top frame is lowered into adjacency with the bottom of the supporting surface.

2. The fold-down work surface of claim 1 wherein when said top frame is in a fully deployed position, the top frame is horizontal, perpendicular from the supporting surface, said leg is vertical, and a lower end of each said leg is in contact with a floor surface.

3. The fold-down work surface of claim 2 wherein, as said top frame is rotated so as to raise or lower said second end of said top frame, said each said leg remains vertical, parallel to said slide.

4. The fold-down work surface of claim 3 wherein a container is mounted to said each said leg so as to remain in a constant orientation relative to the supporting surface as said top frame is rotated to raise or lower said second end of said top frame.

5. The fold-down work surface of claim 3 wherein a rigid work surface extension is mounted to said each said leg so as to protrude outwardly of said top frame, and generally co-planar therewith when said top frame is in said deployed position, and so as to remain level as said top frame is rotated to raise or lower said second end of said top frame whereby, once raised, said extension is stored out of the way adjacent the top edge of the supporting surface.

6. The fold-down work surface of claim 5 wherein said extension is braced by secondary brace members mounted between said extension and said each said leg.

7. The fold-down work surface of claim 6 wherein said each said leg is a spaced apart pair of parallel generally linear legs mounted at and to said second end of said support frame.

8. The fold-down work surface of claim 5 further comprising a rigid table top mounted onto said top frame and a rigid table top extension mounted onto said work surface extension.

9. The fold-down work surface of claim 1 wherein a tool support frame is mounted in said top frame for mounting of a tool into said top frame.

10. The fold-down work surface of claim 9 wherein said tool is a saw.

11. The fold-down work surface of claim 1 further comprising a housing mountable to the supporting surface and around said top frame when raised flush against the supporting surface in a stored position for enclosing said top frame, said each parallelogram frame, said lower longitudinal element, said primary brace member, said slide and said track within said housing, whereby only said housing is visible to an observer when said top frame is in said stored position.

12. The fold-down work surface of claim 1 further comprising latch means for releasably latching said top frame flush against the supporting surface when said top frame is raised flush against the supporting surface in a stored position.

13. The fold-down work surface of claim 1 wherein said primary brace member includes a pair of rigid linear braces, each having a corresponding said slide in a corresponding said track mountable to the support surface.

14. The fold-down work surface of claim 13 wherein said pair of braces are spaced apart and parallel, and said corresponding said tracks are also correspondingly spaced apart and parallel.

15. The fold-down work surface of claim 1 further comprising a rigid table top mounted onto said top frame.

16. The fold-down work surface of claim 1 further comprising resilient means mounted in cooperation between said slide and said track so as to resiliently resist rotation of said top frame from a stored position raised flush against the supporting surface to said deployed position, and to resiliently urge said top frame from said deployed position into said stored position, whereby a manual force exerted upwardly at said second end of said top frame is sufficient to raise and smoothly lower said top frame.

* * * * *

UNITED STATES PATENT AND TRADEMARK OFFICE

CERTIFICATE OF CORRECTION

PATENT NO. : 6,978,721 B2
DATED : December 27, 2005
INVENTOR(S) : Timothy J. Myers It is certified that error appears in the above-identified patent and that said Letters Patent is hereby corrected as shown below:

Column 2,
Line 11, “tame” should read -- frame --.

Signed and Sealed this

Fourteenth Day of March, 2006

JON W. DUDAS
*Director of the United States Patent and Trademark Office*